United States Patent [19]

Kodama et al.

[11] Patent Number: 4,574,750

[45] Date of Patent: Mar. 11, 1986

[54] SELF-CONTAINED HYDRAULIC LIFTER

[75] Inventors: Hisashi Kodama, Nagoya; Katsujiro Sato, Toyota; Tetsuomi Tamura, Toyota; Toru Hamamoto, Toyota; Kazuharu Yamada, Toyota, all of Japan

[73] Assignees: Aisin Seiki Kabushiki Kaisha, Kariya; Toyota Jidosha Kabushiki Kaisha, Toyota, both of Japan

[21] Appl. No.: 521,408

[22] Filed: Aug. 8, 1983

[30] Foreign Application Priority Data

Aug. 13, 1982 [JP] Japan ..... 57-122964[U]
Aug. 13, 1982 [JP] Japan ..... 57-122966[U]
Aug. 13, 1982 [JP] Japan ..... 57-122967[U]

[51] Int. Cl.[4] ..... F01L 1/24
[52] U.S. Cl. ..... 123/90.58; 123/90.55
[58] Field of Search ..... 123/90.55, 90.56, 90.57, 123/90.58, 90.46; 138/30

[56] References Cited

U.S. PATENT DOCUMENTS

| | | | |
|---|---|---|---|
| 3,516,393 | 6/1970 | Dadd | 123/90.55 |
| 4,191,142 | 3/1980 | Kodama | 123/90.55 X |
| 4,274,446 | 6/1981 | Zahid | 138/30 |
| 4,368,699 | 1/1983 | Kodama | 123/90.46 X |
| 4,385,599 | 5/1983 | Hori et al. | 123/90.58 |

*Primary Examiner*—Michael Koczo
*Assistant Examiner*—Peggy A. Neils
*Attorney, Agent, or Firm*—Oblon, Fisher, Spivak, McClelland & Maier

[57] ABSTRACT

A self-contained hydraulic lifter used in valve trains of internal combustion engines having a cylindrical body, a plunger arranged slidably therein, and a diaphragm arranged in the plunger. A metal ring is embedded in the upper portion of the diaphragm and the upper end of the metal ring is in contact with the stopper member fixed to the upper end of the plunger, thereby the sealability of the diaphragm being improved.

5 Claims, 15 Drawing Figures

SELF-CONTAINED HYDRAULIC LIFTER

BACKGROUND OF THE INVENTION

1. Field of the Invention

This invention relates to hydraulic lifters used in valve trains of internal combustion engines and more particularly to a self-contained hydraulic lifter in which the fluid is sealed within the assembly with no provision for its replenishment from any external source during operation.

2. Prior Art of the Invention

The conventional self-contained hydraulic lifter of this type includes a hollow cylindrical plunger which slidably fitted (or disposed or mounted) in a cylindrical body, and a diaphragm that isolates the reservoir in said plunger from atmospheric air is press-fitted to be fixed to the upper opening's inner periphery of said plunger. The cylindrical upper rim of the diaphragm is simply press-fitted to be fixed to the inner periphery of the opening on top of said plunger. Consequently, there is a fear of said diaphragm being floated to deteriorate the sealing performance and causing oil leakage because of the thermal effects after it is press-fitted and the vibration of the running engine transmitted through the push rod, push rod seat, etc.

A metal ring is sometimes embedded in the upper circumferential portion of the diaphragm to improve the sealability of the diaphragm, but the metal ring used for the conventional diaphragm is simply a cylindrical one. As a result, when the engine runs at a high speed, a great force is applied to the fixed portion of the diaphragm with increase in the acceleration of the engine valve train, so that the fixed portion of said diaphragm, being unable to withstand that force, moves downward causing a fear of the diaphragm contacting the inner bottom of the plunger. Further, as the outer periphery surface of the metal ring (29) is simply a flat cylindrical surface, the contact between the metal ring embedded portion and the diaphragm become loose, causing a fear of the diaphragm alone moving downward.

One possible means of not allowing the diaphragm contacting the bottom in the plunger when the diaphragm has moved downward is to increase the gap between the diaphragm and plunger bottom or to increase the clamping margin of the diaphragm fixed portion (press-fitted portion). In the former case, however, the ability to absorb the change in the volume of the oil deteriorates if the diaphragm is shortened, leading to damage of the diaphragm. On the other hand, if the plunger is extended so as not to allow the diaphragm to contact the plunger inner bottom, it will increase the weight and the overall length of the lifter and eventually increase the acceleration of the valve motion system. If the clamping margin is increased, problems such as torn rubber of the fixed portion arise.

SUMMARY OF THE INVENTION

An object of this invention is to provide a self-contained hydraulic lifter that can prevent the diaphragm from moving upward to overcome the aforementioned problems. According to one illustrative embodiment of the present invention, a stopper member is provided which is in contact with the upper surface of the metal ring embedded to the upper circumferential portion of the diaphragm and which is fixed to the upper rim of the plunger opening. Since the metal ring embedded to the upper circumferential portion of the diaphragm is in contact with the stopper member fixed to the upper rim of the plunger opening, the upward movement of the diaphragm is completely inhibited when the diaphragm is about to move upward due to the thermal effects, vibration of the running engine, etc. Moreover, as the stopper member is arranged so that it does not contact the push rod seat, the diaphragm equipped with the metal ring is completely separated from the push rod seat and isolated from bad influence due to the relative movement between the plunger and the push rod seat. Thus the sealability between the diaphragm and the plunger does not deteriorate and failures due to oil leakage can be completely avoided.

Another object of this invention is to provide a self-contained hydraulic lifter that can prevent the diaphragm from moving downward in the plunger to overcome the aforementioned problems. According to another illustrative embodiment of the present invention, a flange is provided at the top of the metal ring embedded and fixed to the upper circumferential portion of the diaphragm. When the upper circumferential portion of the diaphragm is press-fitted to the upper opening's inner periphery of said plunger, the flange under surface of the aforementioned metal ring is brought into contact with the upper end surface of said plunger. As a result, the flange of the metal ring contacts the upper end surface of the plunger and the diaphragm does not move downward even when a great force is applied to the fixed portion of the diaphragm by increased acceleration of the valve motion system in high speed running of the engine. Thus the problems of the diaphragm lowering and contacting the inner bottom of the plunger to cause damage can be prevented.

A further object of this invention is to provide a self-contained hydraulic lifter which can prevent the diaphragm and the metal ring embedded in its upper circumferential portion from coming off and the diaphragm from moving downward. According to a further illustrative embodiment of the present invention, the outer periphery surface and/or the inner periphery surface of the metal ring embedded in the upper circumferential portion of the diaphragm is provided with a grooved portion into which diaphragm rubber penetrates. This inhibits the metal ring and diaphragm from coming off and eliminates the fear of the diaphragm lowering to contact the inner bottom of the plunger during operation.

The foregoing and other objects, features and advantages of the present invention will be understood more clearly and fully from the following detailed description of preferred embodiments with reference to the attached drawings.

DETAILED DESCRIPTION OF PREFERRED EMBODIMENTS OF THE INVENTION

Figure 1:
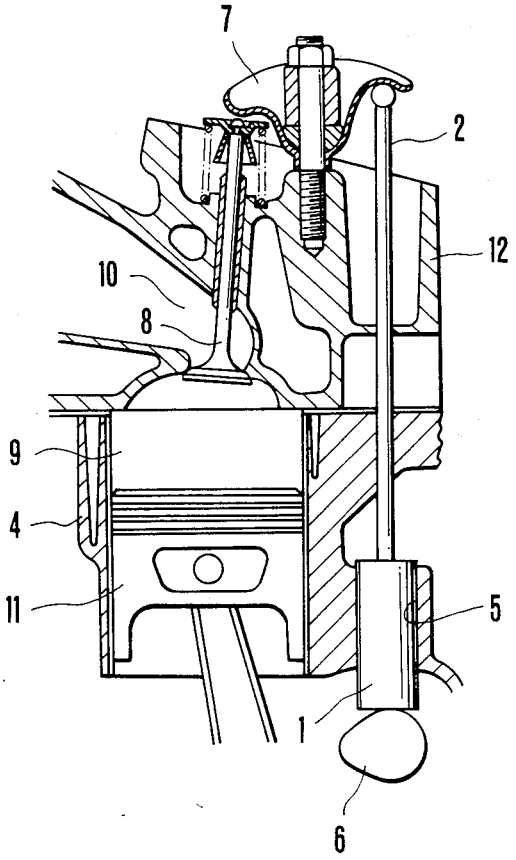
FIG. 1 is a transverse sectional view through a portion of an internal combustion engine having a valve operating train incorporating a self-contained hydraulic lifter constructed in accordance with the present invention.

Referring now to FIG. 1, a self-contained hydraulic lifter (1) according to the present invention is inserted into a hole (5) of an cylinder block (4) with its lower end surface in contact with a cam (6) and can slide up and down by the rotations of the cam (6). The lower end of a push rod (2) is in contact with a push rod seat (3) (shown in FIG. 2) of the hydraulic lifter (1). The internal combustion engine includes a cylinder head (12) secured to the top of the cylinder block (4) thereby forming a combustion chamber (9) above a piston (11). When one end of the rocker arm (7) is pushed up by the push rod (2), the other end pushes down an intake valve or an exhaust valve, thereby controlling the opening and closing of the valve (8) by which the communication between the combustion chamber (9) and a head port (10) can be controlled.

Figure 2:
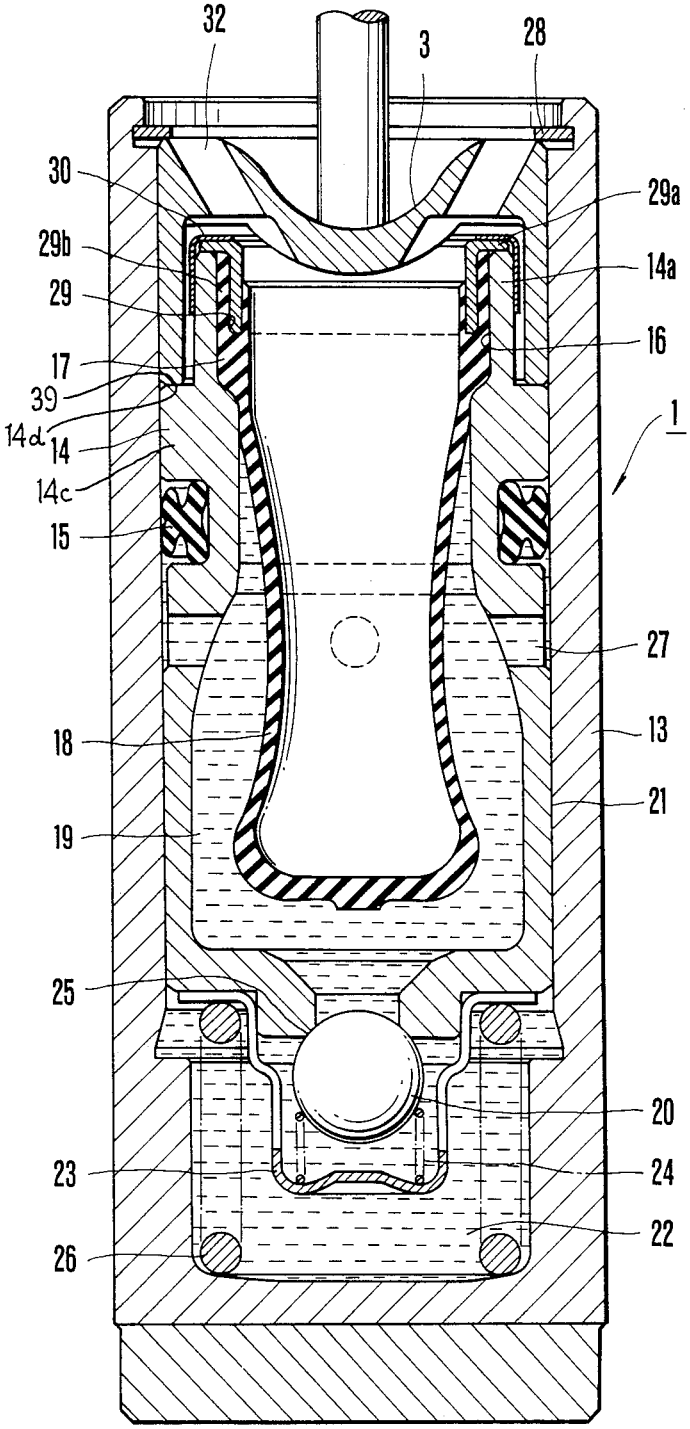
FIG. 2 is a vertical sectional view of the first embodiment of the self-contained hydraulic lifter of the present invention.

As illustrated in FIG. 2, the hydraulic lifter (1) includes a cylindrical body (13) and a hollow cylindrical plunger (14) slidably fitted in the body (13) and a push rod seat having a cap-like shape. The upper portion (14*a*) of the plunger has a diameter smaller than the diameter of the main portion (14*c*) of the plunger, and there is formed a shoulder portion (14*d*) between the upper portion (14*a*) and the main portion (14*c*). There is formed a gap between the upper end of the plunger (14) and the internal top surface of the push rod seat (3) as well as between the outer circumference of the upper portion (14*a*) of the plunger (14) and the internal vertical surface of the push rod seat. Therefore, the push rod seat is in contact with the plunger only between the lower end (3*a*) of the push rod seat and the shoulder (14*d*) of the plunger. In said plunger (14), a reservoir (19) sealed from outside is formed in said plunger (14) by a seal member (15) mounted on its outer periphery surface and a bottomed cylindrical diaphragm (18) of which circumferential portion (17) is press fitted to be fixed to the opening's inner periphery (16) at the top of said plunger. Said reservoir (19) communicates with the pressure chamber (22) at the bottom of the body (13) through the check valve (20) and the leak gap (21) between the body (13) and plunger (14), and oil is sealed in said pressure chamber (22) and reservoir (19).

A check valve (20) in the form of a ball is pressed on a valve seat (25) at the bottom of the plunger (14) by a biasing force of a spring (24) supported by a cage (23), and the cage (23) is held on the bottom of the plunger (14) by a biasing force of a spring (26) supported to the bottom of the pressure chamber (22). In the plunger (14) there is provided an aperture (27) through which the leak gap (21) communicates with the reservoir chamber (19) and the pressure chamber (22). A snap ring (28) prevents the plunger (14) inserted into the body (13) and the push rod seat (3) from springing outside before being mounted in an engine because of the controlling force of the spring (26).

Figure 14:
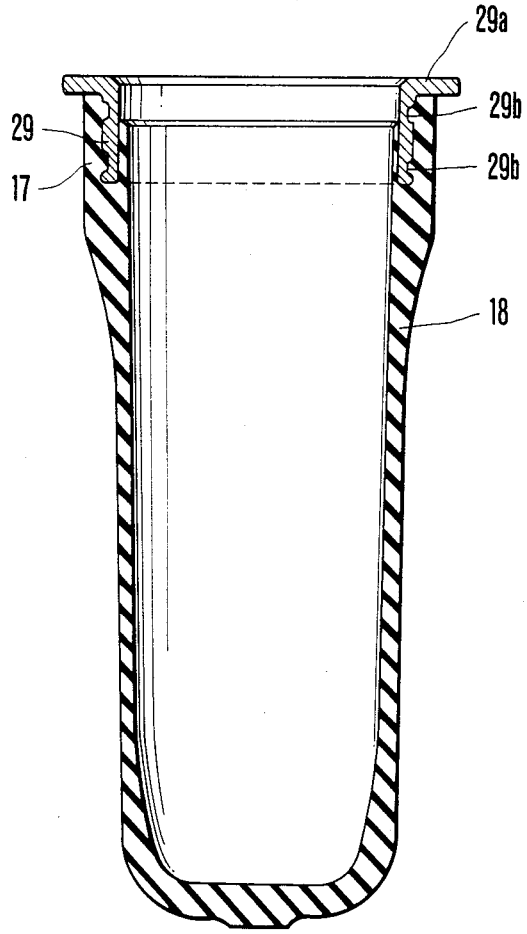
FIG. 14 is a vertical sectional view of another variation of the diaphragm used in the hydraulic lifter of the present invention.
Figure 15:
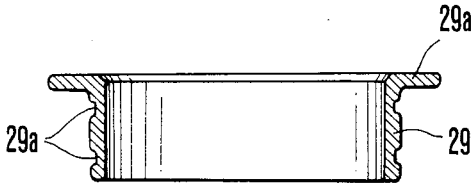
FIG. 15 is a front sectional view of the metal ring shown in FIG. 14.

A metal ring (29) is embedded and adhered to the upper circumferential portion (17) of the diaphragm (18), and a flange (29*a*) is formed on the upper end of metal ring (29). The under surface of the flange (29*a*) is in contact with the upper end of the plunger (14), thereby preventing the diaphragm (18) from sliding down into the reservoir (19) because of loose contact between the inner periphery (16) of the plunger (14) and the press-fitted portion. There is formed a groove (29*b*) on the outer periphery of the metal ring (29), and said groove (29*b*) is so made that when said metal ring (29) is embedded in the upper circumferential portion of the diaphragm (18), rubber of the diaphragm (18) penetrates into said groove (29*b*) to form said metal ring (29) and diaphragm (18) into a completely integral part and the metal ring embedded fixed portion does not come off even when a great force is applied to the diaphragm fixed portion because of increased acceleration of the valve motion system caused by high speed running of the engine. (See FIG. 14 and FIG. 15) These figures show configurations in which two grooves (29*b*) are provided on the outer periphery of the metal ring (29), but the groove (29*b*) can be formed on the inner periphery of the metal ring (29) or can be provided on both sides of the inner and outer peripheries. Possible profiles of the grooves (29*b*) include a screw-shaped groove, saw-tooth groove, and others, in addition to the circumferential groove that intersects the axial center at right angles as shown in the figure.

Figure 3:
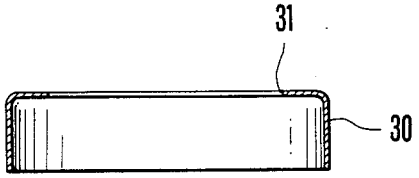
FIG. 3 is a front sectional view of the cap-like stopper in the embodiment shown in FIG. 2.
Figure 4:
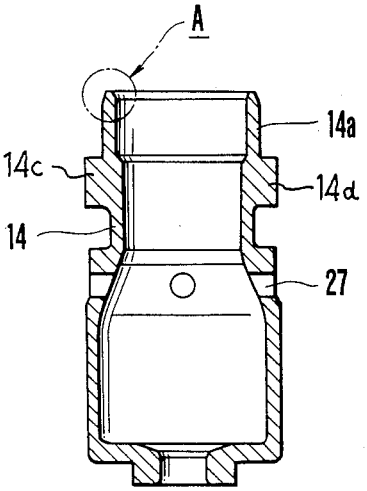
FIG. 4 is a vertical sectional view of the plunger in the embodiment shown in FIG. 2.
Figure 5:
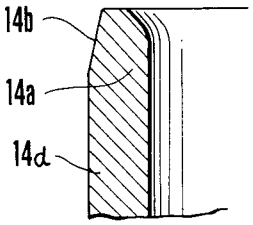
FIG. 5 is an enlarged vertical sectional view of the A portion in FIG. 4.

A cap-like stopper (30) is press-fitted to the outer periphery of the upper portion (14*a*) of the plunger (14) and is in contact with the upper end surface of the metal ring (29) to prevent the diaphragm from floating due to the thermal effects, vibration of the running engine, etc., and a hole (31) (FIG. 3) is provided in the top center so that the push rod seat (3) does not interfere with the stopper. Further, in order to fully prevent the contact of the cap-like stopper (30) with the push rod seat (3), there is a gap between the top surface of the stopper (30) and the internal top surface of the push rod seat as well as between the outer vertical surface of the stopper (30) and the internal vertical surface of the push rod seat (3). The outer peripheral upper rim of the upper portion (14*a*) of the plunger (14) is chamfered (14*b*) (FIG. 5) to press fit the stopper (30). The push rod seat (3) is provided with a passage (32) for communication between the atmosphere and the interior of the diaphragm (18).

Now, the valve train shown in FIG. 1 pushes up the plunger (14) as the spring (26) in FIG. 2 extends, thereby the push rod (2) being pushed upward and lifter adjustment being made through the rocker arm (7).

Here, the oil in the reservoir enters the pressure chamber (22) through the check valve (20). When the cam (6) rotates to push the hydraulic lifter (1) upward, the check valve (20) closes and the leak gap (21) resists the passage of the oil, so that the pressure chamber (22) is pressurised and the push rod (2) is pushed upward.

With the lifter adjustment made in this manner, the volume of the oil in the reservoir (19) increases or decreases with each lifter adjustment and the diaphragm (18) swells or contracts to change its shape.

Here, since the diaphragm (18) is prevented from moving upward by the stopper (30) fixed to the upper portion of the plunger (14) through the metal ring, the diaphragm (18) does not float due to the thermal effects or vibration of the running engine and the sealing performance of the inner periphery surface of the plunger (14) is not deteriorated.

Figure 6:
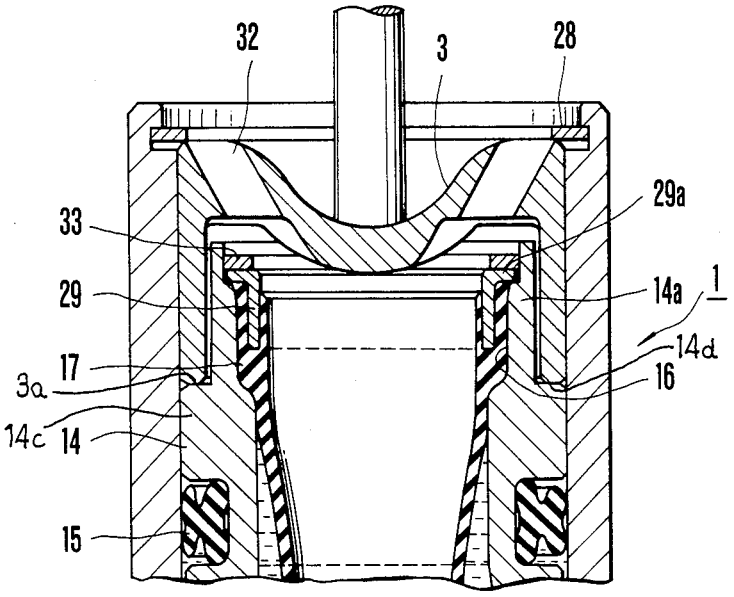
FIG. 6 is a vertical sectional view showing the second embodiment of the upper portion of the hydraulic lifter of the present invention.
Figure 7:
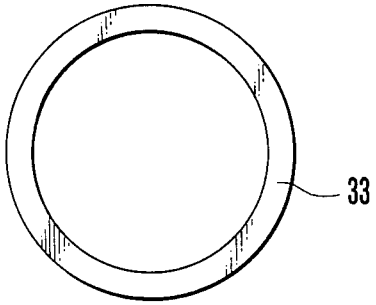
FIG. 7 is a top view of the ring-like stopper in the embodiment shown in FIG. 6.
Figure 9:
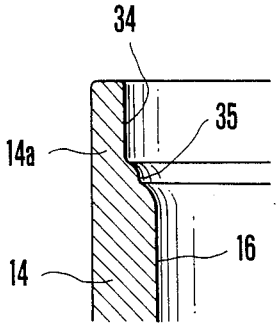
FIG. 9 is an enlarged vertical sectional view of the upper end portion of the plunger in the embodiment shown in FIG. 6.
Figure 8:
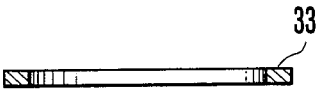
FIG. 8 is a front sectional view of the stopper shown in FIG. 7.

FIG. 6 shows an embodiment that differs from that shown in FIG. 2. In this embodiment, a ring-like stopper (33) is press-fitted to the opening's inner periphery (34) above the inner periphery (16) at the top of the plunger (14), instead of the cap-like stopper member (30) shown in FIG. 2. The lower rim of the flange (29*a*) of the metal ring (29) is in contact with the step portion (35) at the bottom of the opening's inner periphery (34) so that the lower rim is prevented from lowering and the uppersurface of the flange (29*a*) is in contact with the stopper (33) so that the diaphragm (18) does not move upward. This embodiment is no different from the aforementioned embodiment in its function and effect. Here, the upper peripheral portion (17) of the diaphragm (18) is pressfitted to the upper inner periphery (16) of the plunger (14), but the flange (29*a*) of the metal ring (29) only contacts the step portion (35) at its lower rim and the outer periphery of the flange (29*a*) is not press-fitted into the plunger.

Figure 10:
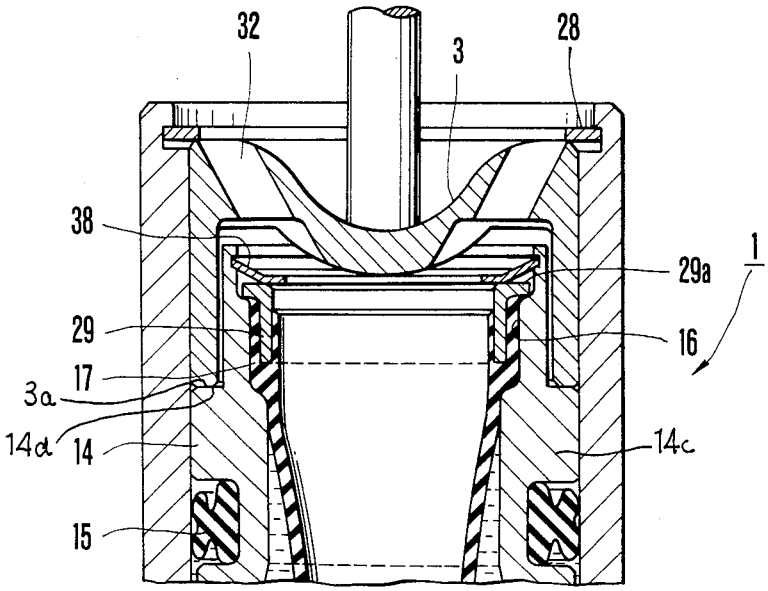
FIG. 10 is a vertical sectional view showing the third embodiment of the hydraulic lifter of the present invention.
Figure 11:
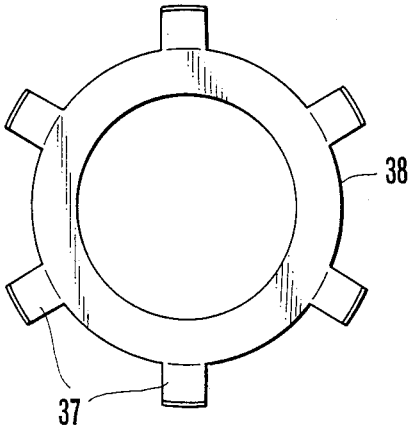
FIG. 11 is a top view of the circular ring-shaped stopper in the embodiment shown in FIG. 10.
Figure 12:
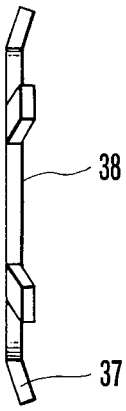
FIG. 12 is a sectional side elevation of the stopper shown in FIG. 11.
Figure 13:
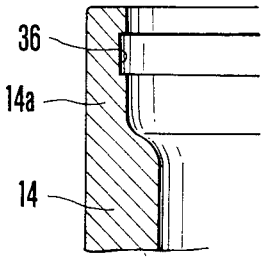
FIG. 13 is an enlarged vertical sectional view of the upper end portion of the plunger in the embodiment shown in FIG. 10.

FIG. 10 also shows another different embodiment. A circular ring-like stopper (38) which is in contact with the upper surface of the flange (29*a*) of the metal ring (29) is mounted in such a manner that the pawl portion (37) (FIG. 13) springily contacts the groove portion (36) provided in the inner periphery of the upper portion (14*a*) of the plunger (14). This inhibits the diaphragm (18) from moving upward. This embodiment is no different from the aforementioned embodiment in its function and effect either.

It should be understood that the preferred embodiments of the present invention have been described herein in considerable detail and that certain modifications, changes, and adaptations may be made therein by those skilled in the art and that it is hereby intended to cover all modification, changes and adaptations thereof falling within the scope of the appended claims.

What is claimed is:

1. A self-contained hydraulic lifter for internal combustion engines comprising:

a cylindrical body having a push rod seat of cap-like shape slidably inserted into the upper portion of the body;

a plunger inserted into the body and vertically slidable along with the push rod seat, said plunger being in contact with the lower end of said push rod seat only at a shoulder portion formed on the outer circumference of the plunger, the entirety of an internal vertical side surface of said push rod seat being separated from the outer surface of the plunger by a gap formed therebetween, and the bottom of said plunger being in contact with a spring arranged at the bottom of said cylindrical body;

a diaphragm arranged in said plunger, an upper circumferential portion of said diaphragm being pressfitted to the upper opening of said plunger;

a reservoir formed in said plunger by the inner peripheral wall of the plunger and the outer peripheral surface of the diaphragm, the bottom of the reservoir communicating with a pressure chamber at the bottom of said cylindrical body through a check valve, with oil being sealed in the reservoir and the pressure chamber;

a cylindrical metal ring embedded in the upper circumferential portion of said diaphragm; and a stopper member fixed to the upper end of the plunger, said stopper member being separated from said push rod seat by a gap and being in contact with the upper end of the metal ring.

2. A self-contained hydraulic lifter for internal combustion engines according to claim 1, wherein the stopper member has a cap-like shape and is fitted to the upper end of the plunger with pressure, said stopper member being separated from the push rod seat by a gap between the internal surface of the push rod seat and the outer surface of the stopper member.

3. A self-contained hydraulic lifter for internal combustion engines in claim 1, wherein the stopper member has a ring-like shape and is press-fitted to the upper inside of the plunger.

4. A self-contained hydraulic lifter for internal combustion engines in claim 1, wherein the stopper member has a ring-like shape with claws to resiliently contact a groove provided in the upper inside of the plunger.

5. A self-contained hydraulic lifter used in valve trains of internal combustion engines in claim 1, wherein the metal ring has a flange on its upper outer periphery and is provided with groove means formed on the surface of a vertically extending portion thereof.

* * * * *